US006271814B1

(12) United States Patent
Kaoh

(10) Patent No.: US 6,271,814 B1
(45) Date of Patent: Aug. 7, 2001

(54) DUAL MESSAGE ADVERTISING DISPLAY SYSTEM

(76) Inventor: Andy K. F. Kaoh, 12231 Singing Wood Dr., Santa Ana, CA (US) 92705

( * ) Notice: Subject to any disclaimer, the term of this patent is extended or adjusted under 35 U.S.C. 154(b) by 0 days.

(21) Appl. No.: 09/086,267

(22) Filed: May 28, 1998

(51) Int. Cl.[7] ..... G09G 5/00

(52) U.S. Cl. ..... 345/82; 903/905; 40/409; 40/427; 40/541; 40/553; 40/594; 340/815.45; 362/800

(58) Field of Search ..... 40/409, 427, 541, 40/553, 584, 442; 340/815.41, 815.45, 815.47; 345/82, 903, 905; 362/800

(56) References Cited

U.S. PATENT DOCUMENTS

| | | | | |
|---|---|---|---|---|
| 3,688,008 | * | 8/1972 | Krieger | 434/268 |
| 4,052,806 | | 10/1977 | George . | |
| 4,574,269 | | 3/1986 | Miller . | |
| 4,868,542 | | 9/1989 | Thompson . | |
| 4,928,084 | | 5/1990 | Reiser . | |
| 4,934,079 | * | 6/1990 | Hoshi | 40/427 |
| 5,132,666 | | 7/1992 | Fahs . | |
| 5,506,760 | * | 4/1996 | Eiebler et al. | 362/249 |
| 5,695,346 | | 12/1997 | Sekiguchi et al. . | |
| 5,810,597 | * | 9/1998 | Allen, Jr. et al. | 434/112 |
| 5,914,698 | * | 6/1998 | Nicholson | 345/1 |
| 5,990,802 | * | 11/1999 | Maskery | 340/815.45 |
| 6,008,784 | * | 12/1999 | Acres et al. | 345/82 |

* cited by examiner

*Primary Examiner*—Bipin Shalwala
*Assistant Examiner*—Vincent E. Kovalick
(74) *Attorney, Agent, or Firm*—Price and Gess

(57) ABSTRACT

A dual message advertising display system having a variable electronic display and a fixed printed display formed on a shared display screen. The display screen includes fixed information printed thereon, such as an advertisement, logo, or other message. The display screen further includes a plurality of apertures formed there through to provide visual access to an electronic display positioned behind the display screen. The apertures are formed a predetermined spacing apart from each other so that the fixed information printed on the display screen remains easily perceivable and non-distorted to an onlooker. The predetermined spacing of the apertures is also selected to cause the message appearing on the electronic display to obscure the fixed printed information on the display by causing the onlooker to focus upon the electronic display message when activated. The electronic display is connected to a programmable control unit which allows the information displayed on the electronic display to be variably controlled. The fixed printed information on the display screen remains viewable at all times when the electronic display message is not activated. Thus, the onlooker will not simultaneously perceive both the fixed printed information on the display screen and the electronic display message. This arrangement of the display system allows both fixed printed information and variable informational to be displayed on a shared display area. The display system may further include an audio speaker for outputting an audible signal which is synchronized with the message appearing on the electronic display.

10 Claims, 2 Drawing Sheets

DUAL MESSAGE ADVERTISING DISPLAY SYSTEM

BACKGROUND OF THE INVENTION

1. Field of the Invention

The present invention relates generally to a multiple message display system, and specifically to an improved display system having a fixed display and a variable electronic display providing messages over a shared display area.

2. Description of Related Art

Conventional print advertising is accomplished by printing stationary fixed information and pictures on signs, billboards, posters, etc. The advertisement printed on the display medium is fixed, so that only one advertising message can be displayed at a given time. In an effort to maximize the number of printed advertisements which can be displayed on a single display medium, there have been many types of advertising displayed developed over the years that allow multiple printed advertisements to be displayed in the space occupied by a single display medium. Such print advertisements have included rotating display screens which periodically rotate the viewable display screen to change to the viewable print advertisement. Other print advertisements have been formed having multiple advertisements printed on a single display, where the particular advertisement perceivable by a viewer changes with the viewer's location in relation to the display where different advertisements come into focus depending upon the viewer's location. Unfortunately, the information conveyed to a viewer of such printed advertisements is limited to the specific pre-printed messages and images fixed on the display medium.

Electronic displays have also been utilized to display information and advertisements on a display panel, such as a matrix LED panel. The messages displayed on the electronic display are typically programmed into a processing unit connected to the display, wherein the processing unit controls which information is to be displayed on the electronic display. Electronic displays are advantageous over fixed printed displays in that the information to be displayed can be variably changed. However, electronic displays do not allow information to be constantly displayed. Information on an electronic display must be either scrolled across the screen or flashed across the screen in billboard fashion. No information is displayed on an electronic display when the processing unit is not specifically instructing a message to be displayed or if a transmission error occurs between the processing unit and the display panel.

One attempt to overcome the deficiencies of conventional electronic displays and fixed print displays is disclosed in U.S. Pat. No. 5,132,666 issued to Fahs, which discloses a vehicle-mounted electronic display system which combines an electronic display with a fixed print display. The display system includes two display sections, a variable display electronic screen and a fixed display section mounted above the variable display. Programmed messages can be flashed or scrolled across the electronic screen, while a logo or other advertisement can be constantly displayed on the screen of the fixed display section.

One of the drawbacks of Fahs's vehicle-mounted electronic display system is the increased amount of space required for both the variable display electronic screen and the fixed display screen. A further drawback of the aforementioned display system is the simultaneous display of multiple advertisements adjacent to one another can be confusing to a viewer of the electronic display system at times when information is being displayed on the electronic screen. The viewer may have his attention distracted between the message displayed on the electronic display screen and the advertising message appearing on the fixed display screen, thus reducing the effectiveness of the advertisement.

Clearly, there is a need for an advertising display system which allows both fixed and variable messages to be displayed without having one of the messages distract the attention of a viewer from the other message. Moreover, there is a need for an advertising display system which allows both fixed and variable messages to be displayed on a shared display area in order to reduce the amount of space required to display both types of messages.

OBJECTS AND SUMMARY OF THE INVENTION

It is a primary object of the present invention to overcome the aforementioned shortcomings associated with the prior art.

Another object of the present invention is to provide an advertising display system which allows both fixed and variable messages to be displayed on a shared display area.

Yet another object of the present invention is to provide an advertising display system which allows both fixed and variable messages to be separately viewed from a shared display area.

These as well as additional objects and advantages of the present invention are achieved by providing a dual message advertising display system having a variable electronic display and a fixed printed display formed on a shared display area. The display system includes a display screen having fixed information printed thereon, such as an advertisement, logo, or other message. The display screen includes a plurality of apertures formed there through to provide visual access to an electronic display positioned behind the display screen. The electronic display is preferably an LED display having a matrix of LED elements, where each LED element is positioned adjacent to a respective aperture in the display screen.

The apertures are formed a predetermined spacing apart from each other so that the fixed information printed on the display screen remains easily perceivable and non-distorted to an onlooker. The predetermined spacing of the apertures is also provided to allow the information displayed on the electronic display to be viewed by the onlooker when the electronic display is activated. The spacing of the apertures causes the message appearing on the electronic display to obscure the fixed printed information on the display screen with respect to the perspective of the onlooker by causing the onlooker to focus upon the electronic display message when activated. The fixed printed information on the display screen then becomes unnoticeable to the onlooker. Thus, the onlooker will not perceive both the fixed printed information on the display screen and the electronic display message simultaneously. The fixed printed information on the display screen remains viewable at all times when the electronic display message is not activated. This arrangement of the display system allows both fixed printed information and variable informational to be displayed on a shared display area.

The display system of the present invention may also include an audio speaker device for outputting an audible signal which is synchronized with the message appearing on the electronic display. A control unit communicates with the display system to provide the messages to be displayed on the electronic display and output on the audio device. The control unit may either be pre-programmed with the messages to be displayed or allow the messages to be input by a user of the display system.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings in which the reference numerals designate like parts throughout the figures thereof and wherein:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an improved dual message advertising display system.

Figure 1:
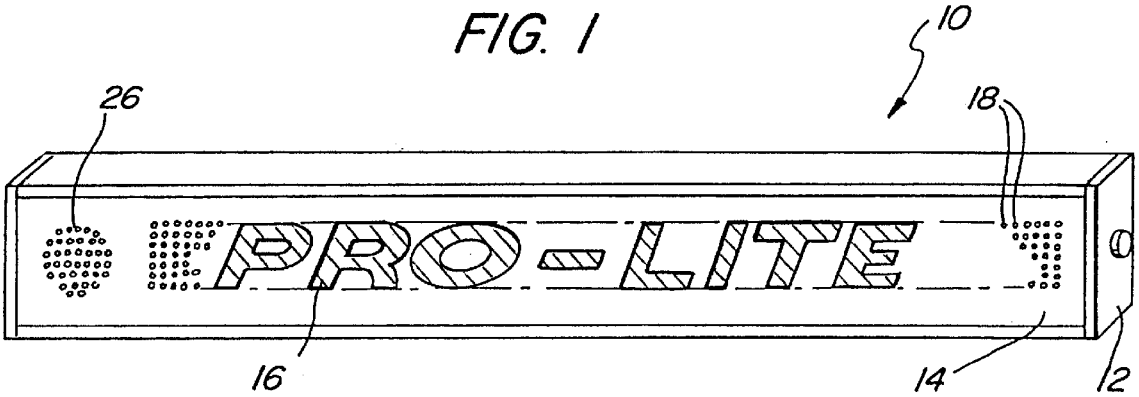
FIG. 1 is a perspective view of a preferred embodiment of the dual message advertising display system of the present invention.

Referring now to FIG. 1, a perspective view of a preferred embodiment of the dual message advertising display system 10 of the present invention is illustrated. The display system 10 includes an outer housing 12 and a display screen 14. The display screen 14 includes a fixed information area 16 having fixed information printed thereon, such as an advertisement, logo, or any other type of message. The display screen 14 includes a plurality of apertures 18 formed there through to provide visual access to an electronic display 20 positioned behind the display screen 14. The electronic display 20 can be programmed to output a textual message, advertisement, or graphical image. The message can appear on the electronic display 20 in a variety of manners, such as being constantly displayed, flashed on the display 20, scrolled across display 20, etc.

Figure 2:
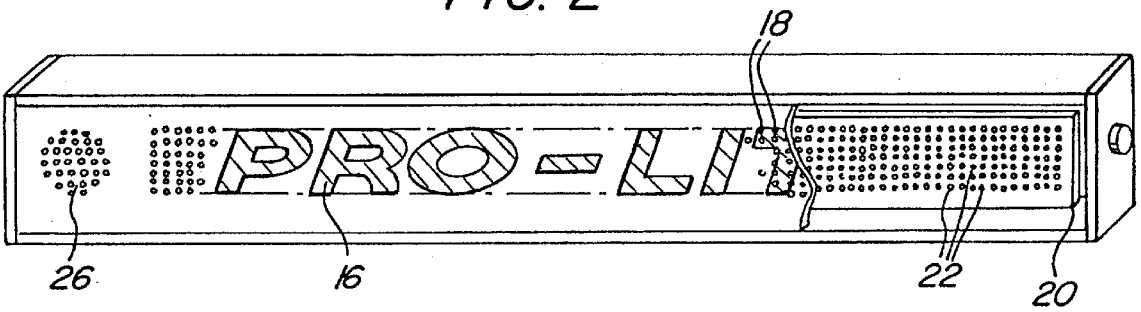
FIG. 2 is a partial cutaway perspective view of the dual message advertising display system of FIG. 1 showing the position of an electronic display screen behind a fixed display screen.

The positioning of the electronic display 20 is further illustrated in the partial cutaway perspective view of the dual message advertising display system 10 in FIG. 2. The electronic display 20 is preferably an LED display having a matrix of LED elements 22, where each LED element 22 is positioned adjacent to a respective aperture 18 in the display screen 14. However, it is understood that other similar electronic display devices may be utilized. By positioning the electronic display 20 directly behind the fixed information area 16 on the display screen 14 where the electronic display 20 is visible through apertures 18, both the electronic display 20 and the fixed information area 16 will share the same viewable area on the display screen 14.

The apertures 18 are positioned a predetermined spacing apart from each other so that the fixed information printed on the display screen 14 appears to be non-interrupted and easily perceivable to a viewer. The surface area of the display screen 14 between the apertures 18 is chosen to allow the fixed information to be printed thereon with a resolution which makes the display screen 14 appear to be uniform and the apertures 18 within the fixed printed information being substantially unnoticeable to the viewer. The predetermined spacing of the apertures 18 is further chosen to allow the information displayed on the electronic display 20 to be visible by the viewer when the electronic display 20 is activated while obscuring the fixed printed information on the display screen 14 with respect to the perspective of the viewer. The distance the electronic display 20 is positioned from the display screen 14 is also selected to accomplish this masking of the fixed printed information. The spacing of the apertures 18 from one another and their spacing from the electronic display 20 causes the viewer to focus upon the message displayed on the electronic display 20 when activated, and the fixed printed information on the display screen 14 then becomes unnoticeable to the viewer. Thus, the viewer will not simultaneously perceive both the fixed printed information on the display screen 14 and the message on the electronic display 20. Further, the electronic display 20 will be substantially invisible to the viewer at all times when the electronic display 20 is not activated.

Figure 3A:
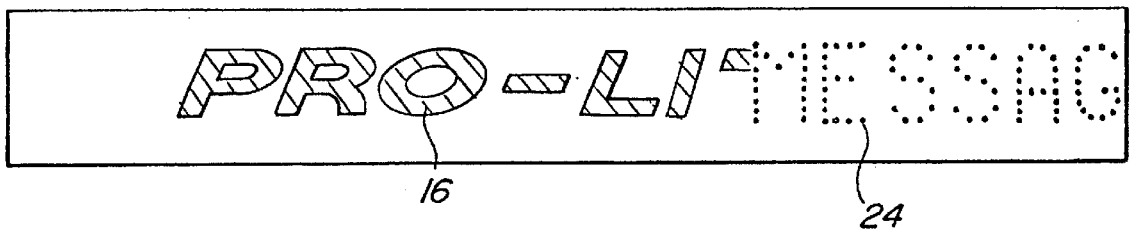
FIG. 3A is a perspective view of the dual message advertising display system of FIG. 1 showing an electronic message beginning to scroll across the electronic display screen.
Figure 3B:
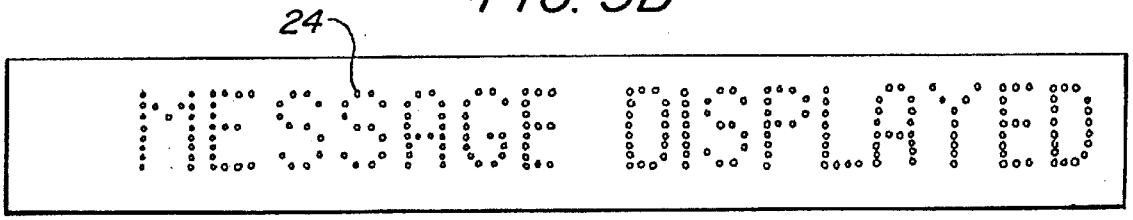
FIG. 3B is a perspective view of the dual message advertising display system of FIG. 1 showing an electronic message displayed across the electronic display screen obscuring the printed message on the fixed display screen.

The fixed printed information in the fixed information area 16 of the display screen 14 remains viewable while the electronic display 20 is blank, as illustrated in FIG.1. As the electronic display 20 is instructed to display a message, the portion of the message appearing on the electronic display 20 which overlaps with the fixed printed information in the fixed information area 16 will obscure the fixed printed information to the viewer. This obscuring of the fixed printed information is illustrated in FIGS. 3A and 3B for a message 24 scrolling across the electronic display 20. As shown in FIG. 3A, when the message 24 begins to scroll across electronic display 20, the portion of the fixed printed information which does not coincide with the scrolling message 24 remains visible. When the scrolling message 24 and the fixed printed information completely coincide as shown in FIG. 3B, only the scrolling message 24 is visible to the viewer. This arrangement of the display system 10 allows both fixed printed information and variable information to be displayed on a shared display screen 14, thus greatly reducing the amount of space required to display both types of information.

The display system 10 of the present invention may also include an audio speaker 26 for outputting an audible signal. The audible signal can be synchronized with the visual message appearing on the electronic display 20 enabling a message to be seen and heard simultaneously. Alternatively, the audible message may include information different from the visual message appearing on the electronic display 20. A control unit 50 communicates with the display system 10 to provide the messages to be displayed on the electronic display 20 and output by the speaker 26. The control unit 50 may either be pre-programmed with the messages to be displayed or allow the messages to be input by a user of the display system 10. The control unit 50 may be formed as a remote device from the display system 10 or may alternatively be formed integrally within the housing 12 of the display system 10.

Figure 4:
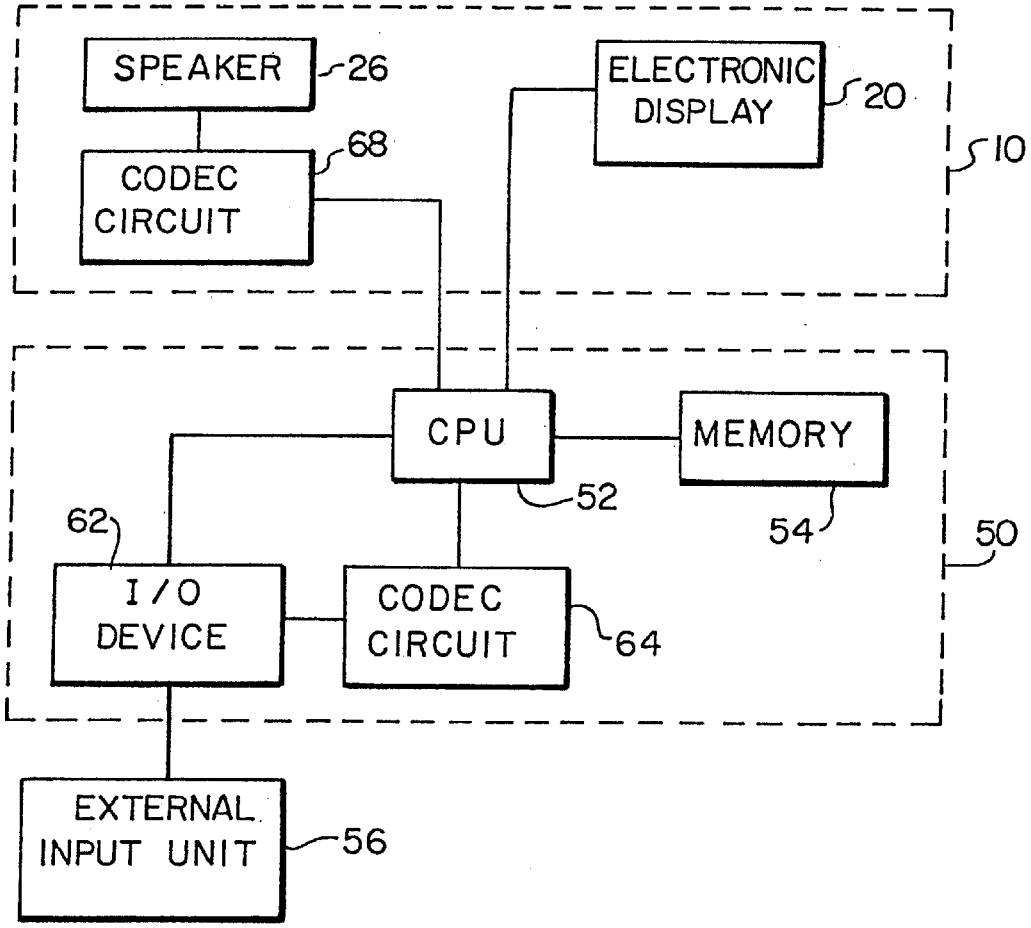
FIG. 4 is a schematic diagram of the control circuitry of the dual message advertising display system of the present invention.

Referring now to FIG. 4, a schematic diagram of the control circuitry for the control unit 50 for the display system 10 is illustrated. The control unit 50 includes a processing device 52 for controlling the operation of the display system 10, wherein processing device 52 may comprise a CPU, microcontroller, or other similar device. A memory 54 is connected to processing device 52 for storing the information to be displayed on electronic display 20 and output by speaker 26. Processing device 52 is connected to communicate with the electronic display 20 and speaker 26, such as through a wired transmission, optical transmission, RF transmission, or other form of communication. Programmed instructions for the manner in which the stored information is to be output by display system 10 are also stored in memory 54.

Figure 5:
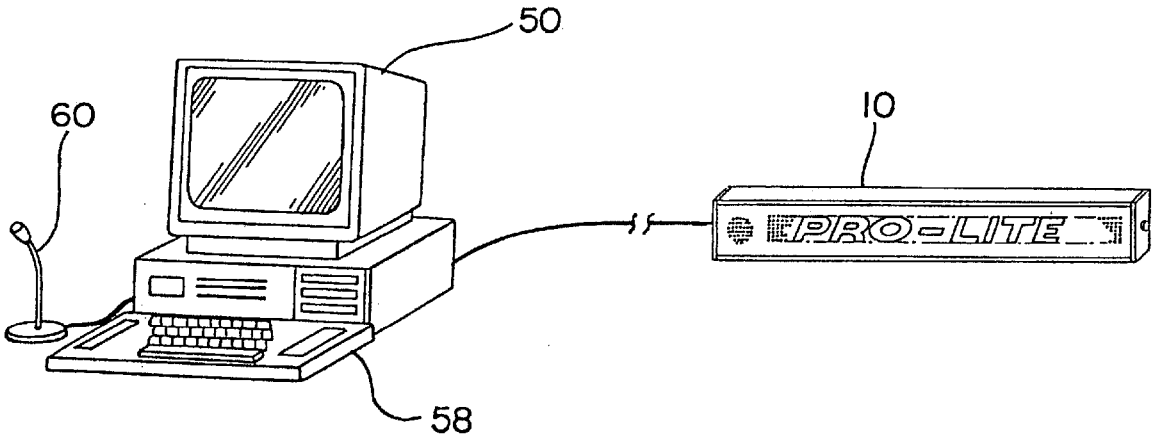
FIG. 5 is a perspective view of a computer terminal connected to the dual message advertising display system of FIG. 1.

An external input unit 56 may also be connected to control unit 50 to allow a user to directly input the information to be output on display system 10. External input unit 56 may include any type of device or combination of devices which allow the user to input data, such as a keyboard, microphone, mouse, etc. In a preferred embodiment of the present invention, control unit 50 comprises a personal computer or other computer terminal remotely connected to the display system 10, as illustrated in FIG. 5. The user may enter the information to be displayed on electronic display 20 through keyboard 58 or speak the message to be displayed into microphone 60. This information is conveyed through an input/output device 62 to CPU 52, which then instructs the display system 10 to output this information.

When a microphone 60 is used as an external input unit 56, the spoken analog voice message must be converted into a digital format. The analog voice signal coming from microphone 60 is passed through a coder/decoder (CODEC) circuit 64 where the voice signal is digitized. CODEC 64 is connected to transfer the digitized signal to CPU 52. The digitized signal is converted into digital voice data, such as in WAV format or other similar voice data format, and textual data, such as in ASCII format. The digital voice data and textual data are compiled into a text string and forwarded by CPU 52 to display device 10. The text string is received by an input/output unit 66 which separates the text string into the digital voice data and textual data. The textual data is forwarded to the electronic display 20 for visual display. The digital voice data is passed through a CODEC circuit 68 where the digital voice data is converted into an analog voice signal to be output by speaker 26. This allows a visual message to be displayed on electronic display 20 simultaneously with an audible message output on speaker 26 simply by speaking the message into microphone 60.

By providing both audible and visual variable message, the display system 10 is extremely effective in conveying varying information to a viewer while also displaying a fixed printed advertisement at times when the variable message is not being output. For instance, the display system 10 could be used as a paging system in a public place, where the person's name being paged would be input through external input unit 56. The person's name would then appear on electronic screen 20 and be announced on speaker 26. At times when the display system 10 was not paging an individual or making a public announcement, an fixed printed advertisement would be viewable on the display screen 14 of the display system 10. The foregoing example is presented for the purpose of illustrating one possible use of the display system 10, and it is not intended to limit the possible other uses of the display system 10 in any manner.

In an alternative embodiment of the present invention, the external input unit 56 may be located locally to the display system 10, such as within the housing 12 containing the electronic display 20 and speaker 26 or attached directly to the housing 12. In this embodiment, the control unit may also be located locally to the display system 10 or may remain remotely located to the display system 10. This allows a user to input information directly into the display system 10 through the external input unit 56 from the location of the display system 10. This information could then be output by the display system 10 in a manner similar to that described above in connection with FIGS. 4 and 5. This information could further be transmitted to CPU 52 and processed in some manner, where the CPU 52 would instruct the display system 10 to output this processed information. Thus, a user could input information, such as an inquiry, which the CPU 52 could process and return an informational answer to be output on display system 10.

As can be seen from the foregoing, an advertising display system formed in accordance with the present invention allows both fixed and variable messages to be displayed on a shared display area in an effective and efficient manner. Moreover, the advertising display system formed in accordance with the present invention allows both fixed and variable messages to be separately and independently viewed from the shared display area.

In each of the above embodiments, the different systems for outputting multiple messages by the advertising display system of the present invention are described separately in each of the embodiments. However, it is the full intention of the inventors of the present invention that the separate aspects of each embodiment described herein may be combined with the other embodiments described herein. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A display device for displaying both fixed information and variable information, comprising:

a display screen having a front surface and a rear surface; the front surface of the display screen having fixed information formed thereon;

the display screen including a plurality of apertures formed between the front surface and the rear surface; and avariable information display for displaying information which may be variably changed; the variable information display being positioned adjacent to the rear surface of the display screen so that the information displayed on the variable information display is viewable from the front surface of the display screen through the plurality of apertures;

wherein the fixed information formed on the front surface of the display screen is only viewable when no variable information is displayed on the variable information display on a concurrent portion of the display screen;

wherein the fixed information becomes visibly imperceivable to an observer by the variable information displayed on the variable information display.

2. The display device of claim 1, wherein the variable information display comprises an electronic LED display having a plurality of light emitting diodes; each of the plurality of light emitting diodes being positioned adjacent to a respective one of the apertures in the display screen.

3. The display device of claim 2, wherein the combination of the plurality of apertures being positioned a predetermined distance apart from each other and the rear surface of the display screen being positioned a selected distance from the variable information display facilitates the fixed information appearing on the display screen being obscured by the variable information appearing on the variable information display.

4. The display device of claim 1, further comprising a speaker device for outputting audible information.

5. The display device of claim 1, further comprising a programmable control unit connected to communicate with the variable information display and provide the information to be displayed on the variable information display.

6. The display device of claim 5, wherein the programmable control unit comprises a personal computer.

7. The display device of claim 4, further comprising a programmable control unit connected to communicate with the variable information display and the speaker device, wherein the programmable control unit provides the information to be displayed on the variable information display and audible information to be output on the speaker device.

8. A dual image display system for displaying two independent and separately perceivable images, comprising:

a display screen for allowing a fixed image and a variable image to be separately viewable, wherein the display screen includes a front surface and a rear surface, wherein a fixed image is formed in the front surface of the display screen;

the display screen including a plurality of apertures extending between the front surface and the rear surface; and a variable image display positioned adjacent to the rear surface of the display screen such that a variable image displayed on the variable image display is viewable through the plurality of apertures to an observer viewing the front surface of the display screen; wherein only one of the variable image and the fixed image is visibly perceivable to the observer on a concurrent portion of the display screen.

9. The dual image display system of claim 8, wherein the fixed image formed on the front surface of the display screen is only visibly perceivable to an observer when no variable image is being displayed on the variable image display to a concurrent portion of the display screen.

10. The dual image display system of claim 9, wherein the display of the variable image on a concurrent portion of the display screen as the fixed image causes the fixed image to become visibly imperceivable to the observer.

* * * * *